US006519809B2

(12) United States Patent
Gutry

(10) Patent No.: US 6,519,809 B2
(45) Date of Patent: Feb. 18, 2003

(54) GUTTER CLEANER

(76) Inventor: Judy A. Gutry, 721 Heath St., Chestnut Hill, MA (US) 02467

( * ) Notice: Subject to any disclaimer, the term of this patent is extended or adjusted under 35 U.S.C. 154(b) by 40 days.

(21) Appl. No.: 09/892,152

(22) Filed: Jun. 26, 2001

(65) Prior Publication Data

US 2001/0042284 A1 Nov. 22, 2001

(51) Int. Cl.[7] ..... A47L 9/02
(52) U.S. Cl. ..... 15/414; 15/327.5; 15/395
(58) Field of Search ..... 15/395, 414, 327.5

(56) References Cited

U.S. PATENT DOCUMENTS 2,623,234 A * 12/1952 Brown ..... 15/414
3,971,098 A 7/1976 Davis
4,223,419 A * 9/1980 Sato et al. ..... 15/327.5
4,402,106 A * 9/1983 Mattson ..... 15/410
4,570,286 A * 2/1986 Ross ..... 15/327.5
4,748,712 A * 6/1988 DiGiovanni ..... 15/327.5
5,056,187 A 10/1991 Higgins
5,195,209 A 3/1993 Watkins
5,586,360 A * 12/1996 Diederiks, Jr. et al. ..... 15/414
6,185,782 B1 2/2001 Hall

* cited by examiner

*Primary Examiner*—Theresa T. Snider
(74) *Attorney, Agent, or Firm*—Morse, Altman & Martin

(57) ABSTRACT

A gutter cleaner having a head and a handle. The head is tubular and has a bend and a nozzle. The bend curves in two orthogonal planes, through an angle of 135° to 195° in one plane and through an angle of 15° to 60° in the other plane. The nozzle has an egress with one dimension being narrower than the other. The head and handle slidably fitting together and are secured to fix their relative positions. The lower end of the handle is adapted to attach to a vacuum source. The handle has a textured surface for gripping and eyelets for removably attaching a shoulder strap. Optionally, the handle has two sections that are slidably fitted together and that can be secured relative to each other.

8 Claims, 4 Drawing Sheets

GUTTER CLEANER

CROSS-REFERENCES TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention relates to gutter cleaners, more particularly, to a vacuum attachment for cleaning building gutters while the user remains on the ground.

2. Description of the Related Art

Gutters around the roofs of building become obstructed with leaves and other debris, eventually clogged to the point where they no longer function properly. Consequently, it is good practice to occasionally clean the gutters of debris. The most common method for cleaning gutters is to either reach the gutter from the roof or from a ladder and manually remove the debris. The danger involved is obvious.

A number of devices have been conceived for cleaning gutters while remaining in relative safety on the ground. Some operate by blowing the debris from the gutter, but some of the debris is blown onto the roof, where the next rain will most likely wash it back into the gutter. Other devices operate on vacuum, suctioning the debris from the gutter. U.S. Pat. No. 3,971,098, issued to Davis, discloses one such device. A U-shaped nozzle at the end of a flexible hose is carried on an adjustable-length pole. The problem with the device of Davis is that it is awkward to manipulate and control, particularly when the gutter is relatively high. U.S. Pat. No. 6,185,782, issued to Hall, discloses a similar device with a flexible hose controlled by an adjustable-length pole, and has the same manipulation and control problems as Davis.

The control problems are somewhat ameliorated by the rigid pipes of U.S. Pat. No. 5,056,187, issued to Higgins, and U.S. Pat. No. 5,195,209, issued to Watkins. Both patents disclose rigid pipes that are adjusted in length by connecting the appropriate number of rigid sections together. Consequently, adjustability of the pipe length is constrained to discrete steps of the available lengths of pipe sections.

The prior art gutter cleaners disclose a suction nozzle that must be pivoted back and forth to reach all areas of the gutter. This pivoting motion can be awkward, particularly with those cleaners that are controlled by a pole. Additionally, the ingress of the prior art nozzles is round, which may be the easiest to manufacture, but may not be the most efficient shape for cleaning gutters. The gutter cleaner of Higgins discloses the ability to fit attachments to the nozzle, but there is no discussion of the most efficient shape for cleaning gutters.

BRIEF SUMMARY OF THE INVENTION

An object of the present invention is to provide a gutter cleaner that has a rigid pipe with a length that is infinitely adjustable for comfort and control during use.

Another object is to provide a gutter cleaner with a head that is curved to more easily reach all areas of the gutter.

Yet another object is to provide a gutter cleaner with a nozzle designed to more efficiently suction debris from gutters.

A further object is to provide a gutter cleaner that attaches to readily available wet/dry vacuum cleaners.

Briefly, the gutter cleaner of the present invention includes a head and a handle. The head is tubular and has a bend and a nozzle. The bend curves in two orthogonal planes, through an angle of 135° to 195° in one plane and through an angle of 15° to 60° in the other plane. The nozzle has an egress with one dimension being narrower than the other. The head and handle slidably fitting together and are secured to fix their relative positions. The lower end of the handle is adapted to attach to a vacuum source.

The gutter cleaner of the present invention is an adjustable-length hollow tube with a specially-designed suction head. The gutter cleaner connects to a vacuum cleaner for suctioning debris from gutters and other similar articles. The gutter cleaner has a head and a handle that reciprocate relative to each other. Optionally, the handle includes a grip and an extension that reciprocate relative to each other. The head has a bend that curves in two orthogonal planes, unlike the gutter cleaners of the prior art that curve in only one plane. In one plane, the bend extends through a fixed angle of from 135° to 195° and, in the other plane, the bend extends through a fixed angle of from 15° to 60°. The advantage to the two-plane bend is that reaching into crevices, corners, under the spacing brackets is easier.

The nozzle ingress has an oval shape. The ingress is significantly narrower in the same dimension as the large bend plane than it is the orthogonal dimension. An oval ingress allows the nozzle to more easily reach into narrow gutters and crevices, has less chance of getting snagged.

The head slides within the handle and can be secured to fix the length of the gutter cleaner. Optionally, the handle has an extension section that slide within a grip section, and that can be secured to fix the length of the gutter cleaner.

The outer surface of the handle is textured to provide a non-slip grasping surface The outer surface also has a series of eyelets for anchoring a strap that can fit over the user's shoulder to support the weight of the gutter cleaner. The lower end of the handle has an attachment for a vacuum source, typically a wet/dry vacuum cleaner.

Other objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION OF THE INVENTION

Figure 1:
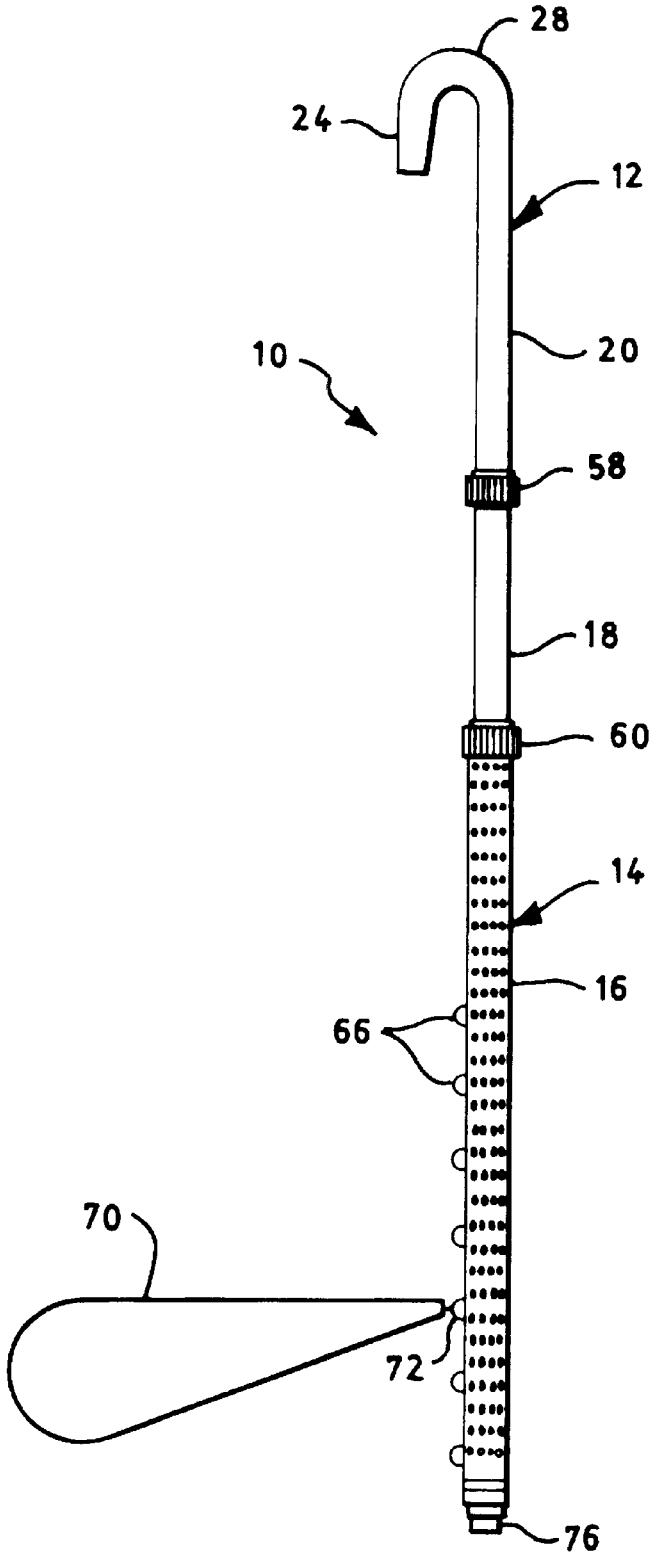
FIG. 1 is a perspective view of the gutter cleaner of the present invention.
Figure 2:
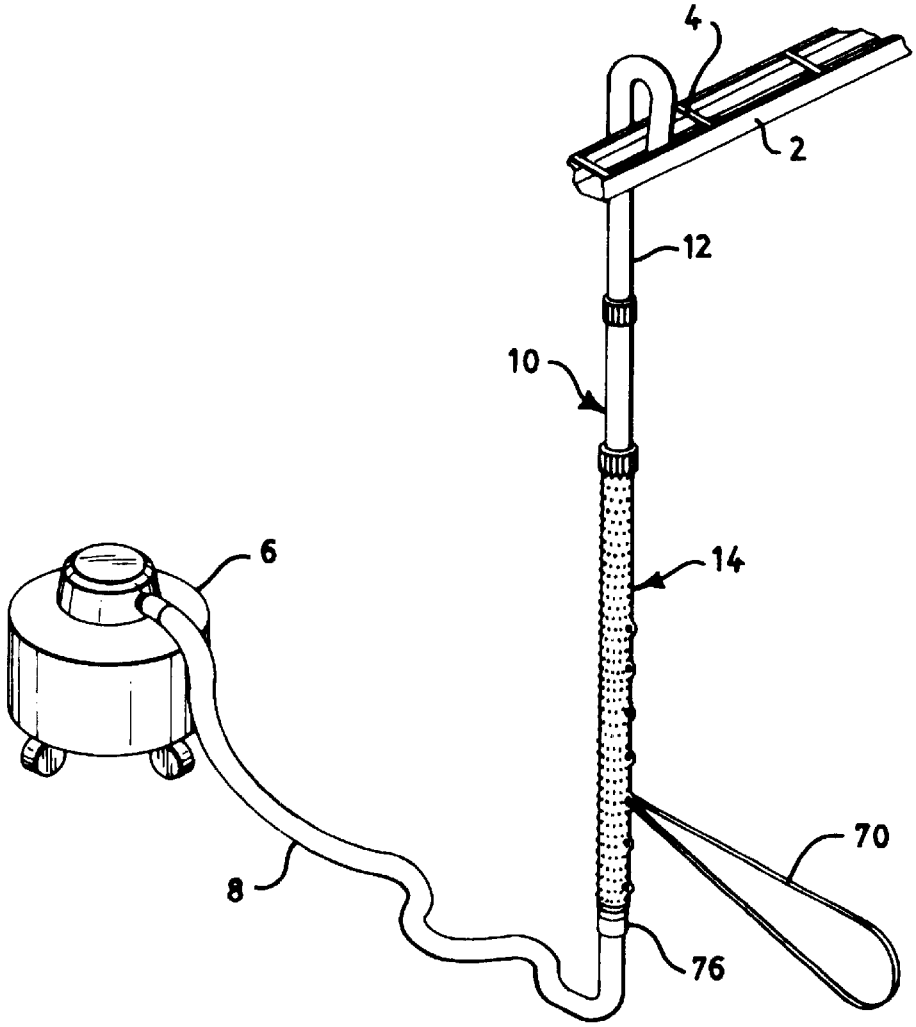
FIG. 2 is a perspective view of the gutter cleaner of FIG. 1 in use.

The gutter cleaner 10 of the present invention is shown in FIGS. 1 and 2. It is, in essence, an adjustable-length hollow tube with a curved head that connects to a wet/dry vacuum cleaner for suctioning debris from gutters 2 and other similar articles. The inventive aspect lays, in part, in characteristics of the head and the adjustable-length nature of the body.

Figure 3:
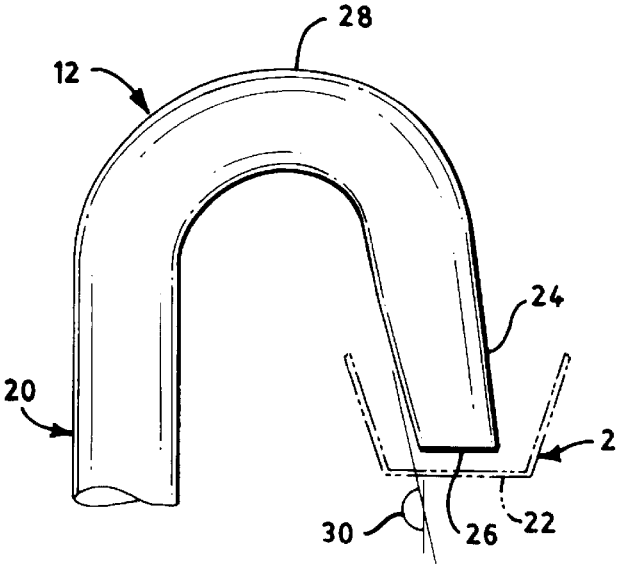
FIG. 3 is an end view of the head of FIG. 1.
Figure 4:
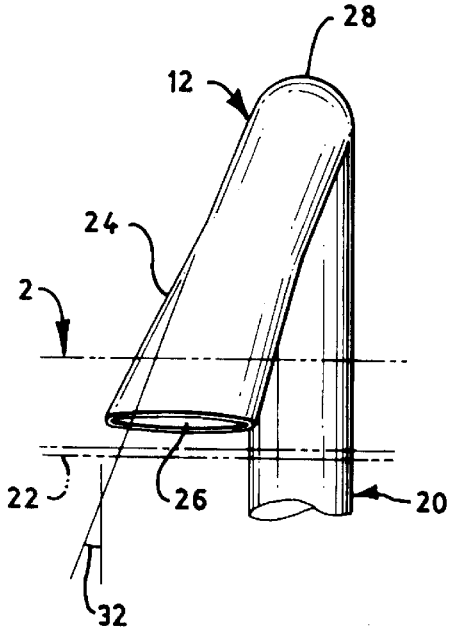
FIG. 4 is a side view of the head of FIG. 1.

The gutter cleaner of the present invention includes a head 12 and a handle 14. Optionally, the handle 14 includes a grip 16 and an extension 18, as shown in FIGS. 1 and 2. The head 12 has a straight hollow tube portion 20, bend 28, and a nozzle 24. As shown in FIGS. 3 and 4, the bend 28 curves in two planes (three dimensions). In the gutter cleaners of the prior art, the bend curves in only one plane (two dimensions), that is, the bend curves such that the head remains planar with the rest of the cleaner. The bend 28 of the present invention curves in two orthogonal planes so that the nozzle 24 is not planar with the tube portion 20. In the first plane, the bend 28 extends through a fixed angle 30 in the range of from about 135° to about 195°, as in FIG. 3. The amount of angle is such that when the user is holding the gutter cleaner 10 up to the gutter 2 in a comfortable manner, the nozzle 24 will be approximately vertical within the gutter when viewed as in FIG. 3. In the second plane, the bend 28 extends through a fixed angle 32 in the range of from about 15° to about 60°, as in FIG. 4. When the user holds the gutter cleaner 10 perpendicular to the gutter 2, the nozzle 24 will be at an angle, not perpendicular, to the gutter floor 22 when viewed as in FIG. 4.

This three-dimensional bend 28 has an advantage over the gutter cleaners of the prior art in that the gutter cleaner 10 does not need to be tilted or rocked to clean in crevices, in corners, or under the spacing brackets 4 that are used to support and maintain the shape of the gutter 2.

Figure 5:
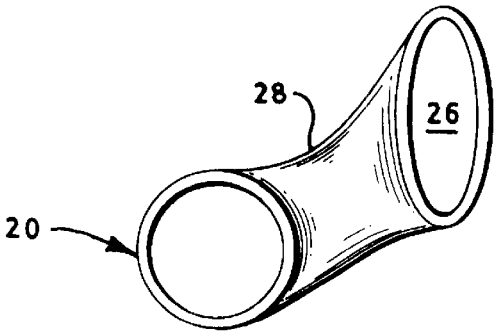
FIG. 5 is a bottom view of the head of FIG. 1.

Also unlike gutter cleaners of the prior art, the nozzle ingress 26 is not round, but has an approximately oval shape, as shown in FIG. 5. The nozzle ingress 26 extends in two orthogonal dimensions approximately parallel to the two bend planes. The nozzle ingress 26 is significantly narrower in the dimension that is approximately parallel to the first plane, the plane in which the head bends through the 135° to 195° angle, than it is in the orthogonal dimension. The present invention contemplates that the ingress does not have to be an oval, but may be any similar shape, such as a rectangle or rectangle with rounded corners.

There are several advantages to an oval nozzle ingress. The narrow parameter allows the nozzle 24 to more easily reach deep into narrow gutters and crevices. It also reduces the chances of the nozzle 24 getting snagged on items within the gutter 2. To compensate for the narrow parameter, the wide parameter gives the nozzle ingress 26 enough surface area so that large leaves and debris do not get jammed in the ingress 26.

Figure 6:
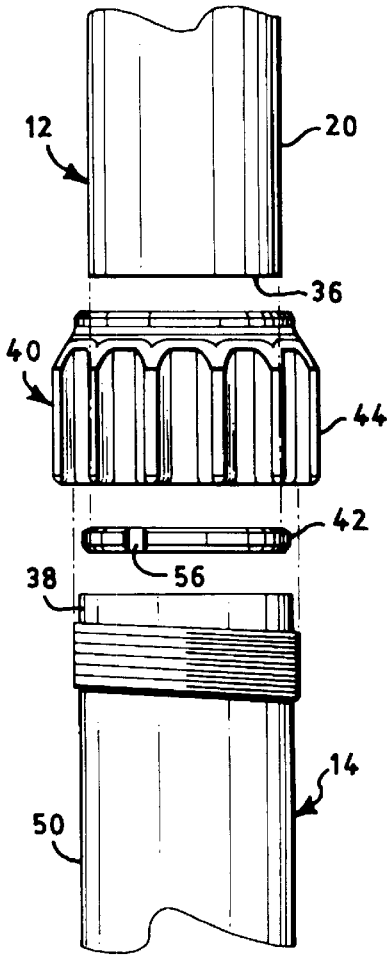
FIG. 6 is an exploded view of the securement of the present invention.
Figure 7:
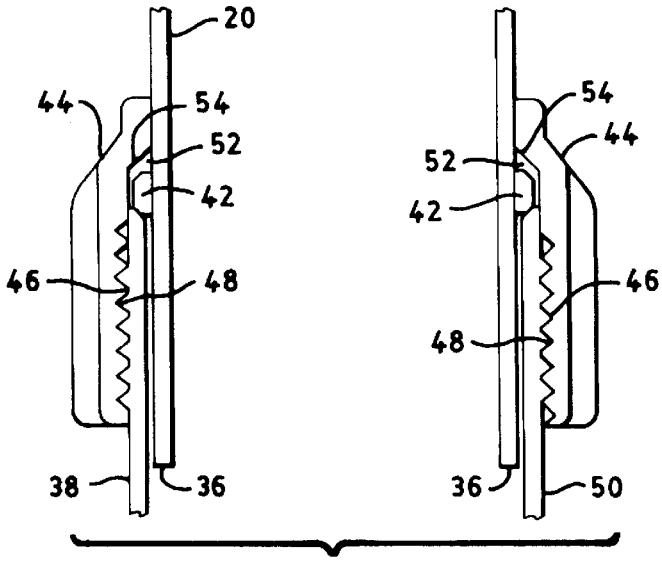
FIG. 7 is a cross-sectional view of the securement of the present invention.

The lower end 36 of the head 12 has an outside diameter that is slightly smaller than the inside diameter of the upper end 38 of the handle 14 so that the head 12 fits into the handle 14 and can slide relative to each other. The head 12 and handle 14 are secured in the desired position by a securement 40, shown in FIGS. 6 and 7. The implemented securement 40 includes a compression ring 42 and a collar 44. The compression ring 42 fits on the head lower end 36. The collar 44 has internal threads 46 that mate with external threads 48 on the outer surface 50 of the handle 14. The compression ring 42 fits in a space 52 between the head 12 and the collar 44. As the collar 44 is threaded onto the handle 14, a beveled surface 54 on the collar 44 presses the compression ring 42 against the head 12. Friction between the compression ring 42 and the head 12 secures the head 12 so that it cannot slide relative to the handle 14. Optionally, a gap 56 in the compression ring 42 provides for contraction of the compression ring 42 during tightening. The compression ring 42 is preferably composed of a material that can be compressed as needed and that will slide on the surface of the head 12, for example, nylon. The present invention also contemplates that any securement that provides the same result as that of the securement 40 described above may be used.

Optionally, the handle 14 has two sections, the grip 16 and the extension 18, as shown in FIG. 1. The extension 18 slidably fits within the grip 16 in the same manner that the head 12 slidably fits in the extension 18 (the upper part of the handle 14). The head 12 and the extension 18 are secured relative to each other by one securement 58, and the grip 16 and extension 18 are secured relative to each other by another securement 60. Both securements 58, 60 employ the same securement mechanism as described above. Optionally, there may be more than one extension 18.

The outer surface 62 of the handle 16 is preferably textured in some way to provide a relatively non-slip surface for grasping by the user. The present invention contemplates that any number of methods known in the art can be used to texture the surface, including knurling, pebbling, tacky coating, or being composed of a tacky material. The current implementation of the present invention textures the surface 62 using a large number of low rounded protrusions 64 in bands around the outer surface 62. The protrusions 64 may be of various sizes.

Figure 8:
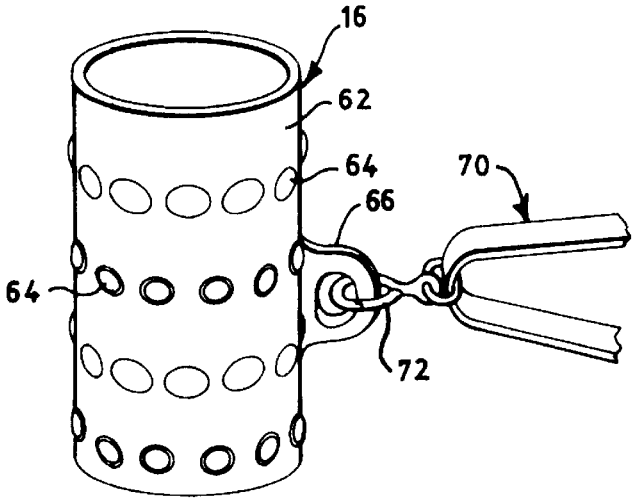
FIG. 8 is a perspective view of the strap attachment.

Also extending from the outer surface 62 of the handle 16 are a series of eyelets 66. The purpose of the eyelets 66 is as an anchor for a strap 70 that can fit over the user's shoulder to support the weight of the gutter cleaner 10. As shown in FIG. 8, the strap 70 includes a clip 72 that permits the strap 70 to be detached from an eyelet 66 and moved to another in order to adjust the strap 70 for different people and/or gutter height. The strap 70 can be made with a length that is fixed or adjustable.

The lower end 76 of the handle 16 has an attachment for a vacuum source 6, typically a wet/dry vacuum cleaner. The typical vacuum cleaner hose attachment uses a friction fit whereby the attachment has a constant-diameter tubular end and the hose has a slightly conical end. The hose end is pushed into the attachment until friction holds them together. Similarly, the handle lower end 76 has a constant diameter in order to attach to the vacuum cleaner hose 8 as just another attachment. The present invention also contemplates that any type of attachment that is used by a vacuum cleaner may be implemented. For example, the hose and handle may both have constant diameters that are designed to mate by a friction fit. The gutter cleaner may be secured to the hose by a clip or other latching mechanism.

The gutter cleaner of the present invention is composed of a material that can support its own weight without significant deformation when held vertically. It is also preferred that the material be relatively light weight in order to facilitate control during use and to keep operator fatigue down. The preferred materials are plastics, such as ABS or PVC.

Thus it has been shown and described a gutter cleaner which satisfies the objects set forth above.

Since certain changes may be made in the present disclosure without departing from the scope of the present invention, it is intended that all matter described in the foregoing specification and shown in the accompanying drawings be interpreted as illustrative and not in a limiting sense.

What is claimed is:

1. A gutter cleaner comprising:

(a) a head and a handle;

(b) said head being tubular and having an open lower end, a bend, and a nozzle;

(c) said bend curving through an angle of approximately 135° to 195° in a first plane and through an angle of approximately 15° to 60° in a second plane orthogonal to said first plane;

(d) said nozzle having an ingress with a first dimension approximately parallel to said first plane and a second dimension orthogonal to said first dimension, said first dimension being smaller than said second dimension;

(e) said handle being tubular and having an outer surface, an open upper end and an open lower end;

(f) said head and said handle slidably fitting together;

(g) a securement means for fixing the relative positions of said head and said handle; and (h) said handle lower end being adapted to attach to a vacuum source.

2. The gutter cleaner of claim 1 wherein said handle is comprised of a grip and an extension, said grip and said extension slidably fitting together, and a securement means for fixing the relative positions of said grip and said extension.

3. The gutter cleaner of claim 1 wherein said securement means includes a compression ring slidably positioned on said head lower end, external threads on said handle upper end, and a collar with internal threads for mating with said external threads, said compression ring fitting within a space between said head and said collar, and whereby, when said collar is turned onto said external threads, said collar presses said compression ring against said head, securing said head position relative to said handle.

4. The gutter cleaner of claim 1 wherein said handle outer surface is textured.

5. The gutter cleaner of claim 1 further comprising a strap, said handle outer surface including a plurality of eyelets, and said strap including a clip for removably attaching said strap to one of said plurality of eyelets.

6. A gutter cleaner comprising:

(a) a head, a handle, and a strap;

(b) said head being tubular and having a bend, a nozzle, and an open lower end;

(c) said bend curving through an angle of approximately 135° to 195° in a first plane and through an angle of approximately 15° to 60° in a second plane orthogonal to said first plane;

(d) said nozzle having an ingress with a first dimension approximately parallel to said first plane and a second dimension orthogonal to said first dimension, said first dimension being smaller than said second dimension;

(e) said handle being tubular, having an open upper end, an open lower end, and a textured outer surface, said outer surface including a plurality of eyelets;

(f) said head lower end and said handle upper end slidably fitting together;

(g) a securement means for fixing the relative positions of said head and said handle;

(h) said handle lower end being adapted to attach to a vacuum source; and (i) said strap including a clip for removably attaching said strap to one of said plurality of eyelets.

7. The gutter cleaner of claim 6 wherein said handle is comprised of a grip and an extension, said grip and said extension slidably fitting together, and a securement means for fixing the relative positions of said grip and said extension.

8. The gutter cleaner of claim 6 wherein said securement means includes a compression ring slidably positioned on said head lower end, external threads on said handle upper end, and a collar with internal threads for mating with said external threads, said compression ring fitting within a space between said head and said collar, and whereby, when said collar is turned onto said external threads, said collar presses said compression ring against said head, securing said head position relative to said handle.

* * * * *